US005659919A

United States Patent [19]

Kajihara

[11] Patent Number: 5,659,919

[45] Date of Patent: Aug. 26, 1997

[54] UPRIGHT VACUUM CLEANER

[75] Inventor: Shinichiro Kajihara, Osaka, Japan

[73] Assignee: Sharp Kabushiki Kaisha, Osaka, Japan

[21] Appl. No.: 520,874

[22] Filed: Aug. 30, 1995

[30] Foreign Application Priority Data

Aug. 30, 1994 [JP] Japan ..... 6-205683

[51] Int. Cl.[6] ..... A47L 9/00

[52] U.S. Cl. ..... 15/325; 15/339; 15/351

[58] Field of Search ..... 15/339, 325, 351, 15/352

[56] References Cited

U.S. PATENT DOCUMENTS

| | | | |
|---|---|---|---|
| 2,210,953 | 8/1940 | Replogle | 15/351 X |
| 2,287,921 | 6/1942 | White | 15/351 X |
| 4,305,176 | 12/1981 | Lessig et al. | 15/325 |
| 4,397,058 | 8/1983 | Koland | 15/325 |
| 5,230,121 | 7/1993 | Blackman | 15/351 X |
| 5,309,601 | 5/1994 | Hampton et al. . | |
| 5,323,510 | 6/1994 | Redding et al. . | |

FOREIGN PATENT DOCUMENTS

| | | |
|---|---|---|
| 59-16773 | 4/1984 | Japan . |
| 61-143559 | 9/1986 | Japan . |

*Primary Examiner*—Chris K. Moore

*Attorney, Agent, or Firm*—Birch, Stewart, Kolasch & Birch, LLP

[57] ABSTRACT

An upright vacuum cleaner includes a suction port body and a handle body which incorporates a fan motor and a dust collecting case and which is mounted to the suction port body to be tiltable about the rotating shaft of the fan motor as the tilting fulcrum. The suction port body is constituted by a suction port base, having a substantially rectangular suction port at a front lower surface thereof through which a rotary brush is exposed, for rotatably axially supporting the rotary brush, and a suction port hood detachably mounted to the suction port base.

12 Claims, 11 Drawing Sheets

UPRIGHT VACUUM CLEANER

BACKGROUND OF THE INVENTION (1) Field of the Invention

The present invention relates to an upright vacuum cleaner and, more particularly, to an upright vacuum cleaner in which a rotary brush, a belt, and the like can be easily exchanged.

(2) Description of the Prior Art

In an upright vacuum cleaner having a conventional suction port body structure, for example, as shown in Japanese Patent Publication Sho 59 No. 16773, Japanese Utility Model Application Laid-Open Sho 61 No. 130142, and the like, when exchanging a rotary brush or belt, the cleaner itself must be turned upside down, and a bottom plate covering the rotary brush must be removed. In the upright vacuum cleaner of each official gazette enumerated above, the rotary brush is held in a suction port body, and a bottom plate covers the rotary brush.

More specifically, referring to FIG. 1, wheels 2 are provided at the bottom portion of a handle body 1, and a suction fan motor 3 is incorporated in the lower portion of the handle body 1. The handle body 1 is mounted to a suction port body 5 to be tiltable about a shaft 4 of the fan motor 3 which serves as the tilting fulcrum. A handle 6 is fixed to the handle body 1, and a dust collecting case 7 is detachably mounted to the front surface of the handle body 1. A panel 8 formed on the upper portion of the front surface of the handle body 1 incorporates a power control board for adjusting an input to the fan motor 3.

Dust drawn by suction through an opening portion 13 formed in the lower portion of the front surface of a bottom plate 12 is collected, through a hose 9, in a dust collecting bag mounted in the dust collecting case 7, and air from which dust is removed is exhausted through an exhaust port 10. A belt 11 for transmitting the driving force of the fan motor 3 to a rotary brush 14 is mounted to the shaft 4 of the fan motor 3. The rotary brush 14 is exposed through the opening portion 13 of the bottom plate 12 detachably mounted to the suction port body 5, so that it can clean the floor surface. A bumper 15 is mounted on the front and two side surfaces of the suction port body 5.

With the above arrangement, however, the rotary brush or belt cannot be exchanged unless the product is turned upside down and the bottom plate is removed from the suction port body. The vacum cleaner must be turned upside down in the same manner as described above also when the handle body is to be mounted to the suction port body to be tiltable about the shaft projecting from the fan motor as the tilting fulcrum. This poses problems in assembling operability and services. When the rotary brush or belt is to be exchanged, a power switch 16 must be turned off to stop the rotary brush or belt, which also poses a problem in exchange operability.

SUMMARY OF THE INVENTION

It is an object of the present invention to provide an upright vacuum cleaner in which the suction port body is divided into two parts to allow easy mounting and removal, so that, e.g., a rotary brush, a belt, and the like can be exchanged easily and safely without turning the body of the cleaner upside down.

It is another object of the present invention to provide an upright vacuum cleaner having a structure in which a microswitch, incorporated in a suction port body, for controlling a fan motor can be protected from dust.

It is still another object of the present invention to provide an upright vacuum cleaner in which the body of the cleaner is protected from an external impact and the air-tightness of the suction port body can be improved.

According to an aspect of the present invention, there is provided an upright vacuum cleaner comprising a suction port body incorporating a rotary brush for cleaning a floor surface, a fan motor for generating a suction force for drawing dust by suction, and for supplying a driving force to the rotary brush, a dust collecting portion for collecting the dust drawn by the fan motor, and a handle body incorporating the fan motor and the dust collecting portion and mounted to the suction port body to be tiltable about a rotating shaft of the fan motor which serves as a tilting fulcrum, wherein the suction port body comprises a suction port base, having a substantially rectangular suction port at a front lower surface thereof through which the rotary brush is exposed, for rotatably axially supporting the rotary brush, and a suction port hood detachably mounted to the suction port base.

In this case, a case body for accommodating a microswitch connected in series with the fan motor and having an opening portion at an upper portion thereof is formed on the suction port base, and a convex pressing body for pressing an operation button provided on the microswitch through the opening portion of the case body is provided to the suction port hood. Furthermore, it is effective to cover the surface of the pressing body with a soft material to seal the opening portion of the case body with the pressing body. Furthermore, it is also effective that a bumper is mounted around the suction port base and the suction port hood and that the end portion of the bumper is clamped between the suction port base and the suction port hood.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

Figure 1:
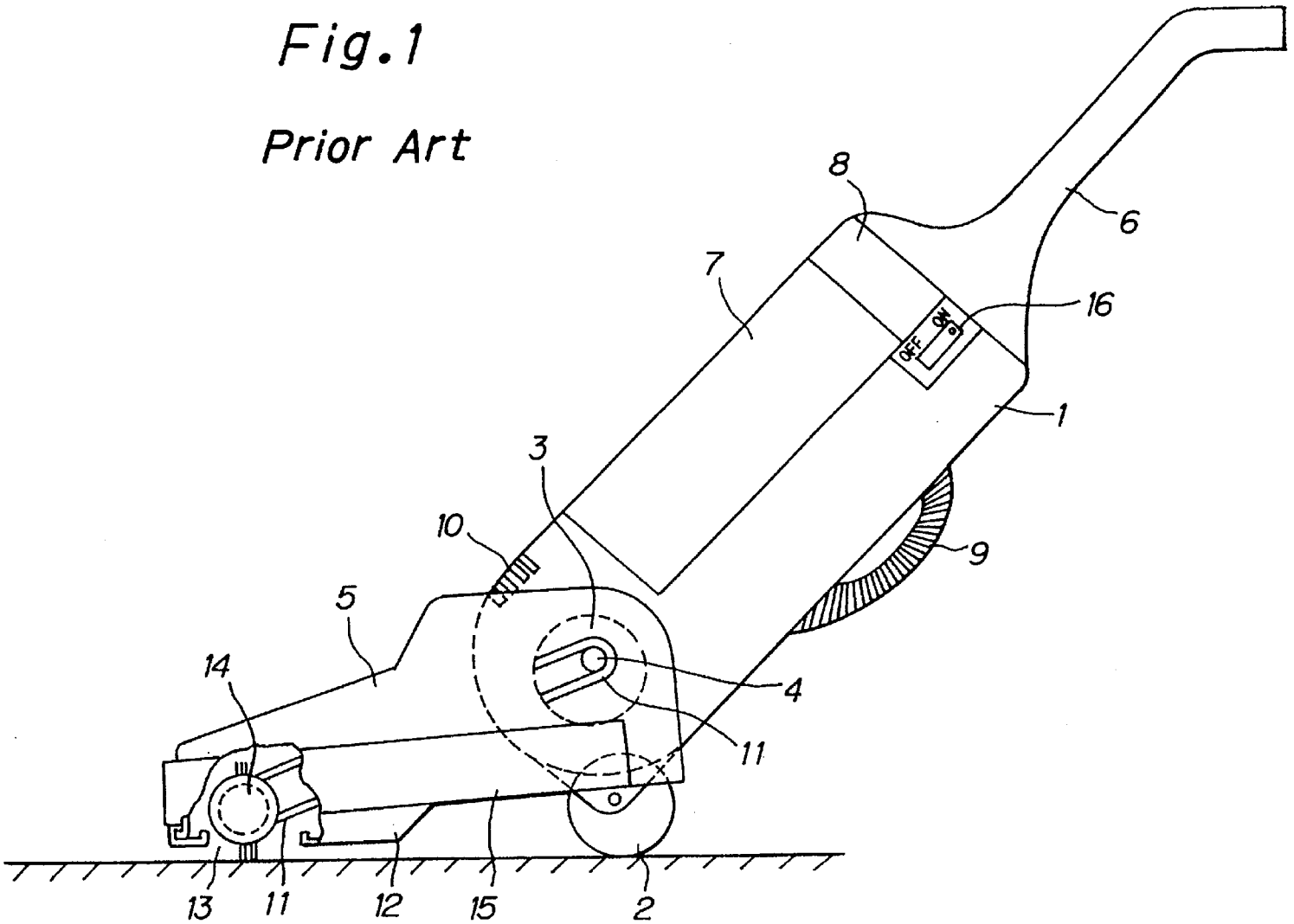
Fig. 1 Prior Art
FIG. 1 is a side view showing a conventional upright vacuum cleaner.

An upright vacuum cleaner according to the present invention comprises a suction port body incorporating a rotary brush for cleaning a floor surface, a suction fan motor assembly for generating a suction force for drawing dust by suction, and for supplying a driving force to the rotary brush, a dust collecting portion for collecting the dust drawn by the fan motor, and a handle body incorporating the fan motor and the dust collecting portion and mounted to the suction port body to be tiltable about a rotating shaft of the fan motor which serves as a tilting fulcrum. The suction port body comprises a suction port base, having a substantially rectangular suction port at a front lower surface thereof through which the rotary brush is exposed, for rotatably axially supporting the rotary brush, and a suction port hood detachably mounted to the suction port base. According to this arrangement, the suction port body is divided into two parts composed of the suction port base, having the substantially rectangular suction port at the front lower surface thereof through which the rotary brush is exposed, for rotatably axially supporting the rotary brush, and the suction port hood detachably mounted to the suction port base. Therefore, the interior of the suction port body can be inspected only by removing the suction port hood from the suction port base without turning the body of the cleaner upside down, so that, e.g., the rotary brush, a belt, and the like can be easily exchanged.

Boss portions having screw holes may extend upright on the suction port base. Opening portions may be formed in the suction port hood at positions corresponding to the positions of the screw holes of the boss portions. The suction port hood may be mounted to the suction port base with screws. Then, the suction port hood can be mounted to and removed from the suction port base by using the screws, so that the suction port hood can be easily mounted on and detached from the suction port base.

In place of mounting the suction port hood and the suction port base to each other by using the screws, as described above, the following means may be employed. More specifically, it is effective that boss portions, to which T-shaped locking bodies are fixed, extend upright on the suction port base, opening portions through which the locking bodies go are formed in the suction port hood at positions corresponding to the positions of the locking bodies, knobs are disposed on the suction port hood to go back and forth slidably on the suction port hood, and notched portions are formed in the knobs so that when the suction port hood is mounted to the suction port base, the knobs are fitted between the locking bodies projecting through the opening portions in the suction port hood and the suction port hood. Thus, in mounting the suction port hood to the suction port base, when the knobs are slid, they are fitted between the locking bodies projecting from the suction port hood and the suction port hood, so that the suction port hood is fixed to the suction port base. As a result, the suction port hood can be easily mounted on and detached from the suction port base without using a tool.

In the cleaner of the present invention, a microswitch connected in series with the fan motor is arranged on the suction port base, a case body for accommodating the microswitch and having an opening portion at an upper portion thereof is formed on the suction port base, and a convex pressing body for pressing an operation button provided on the microswitch through the opening portion of the case body is provided to the suction port hood. More specifically, when the suction port hood is mounted to the suction port base, the convex pressing body enters the opening portion of the case body to press the operation button of the microswitch, thereby turning on the microswitch. Inversely, when the suction port hood is removed from the suction port base, the microswitch is turned off. As a result, in exchanging the rotary brush or the belt, when the suction port hood is removed from the suction port base, rotation of the fan motor is automatically stopped, so that the exchange operation can be safely performed.

The surface of the pressing body may be covered with a soft material to seal the opening portion of the case body with the pressing body. When the surface of the pressing body is covered with the soft material, in this manner, upon mounting the suction port hood to the suction port base, the case body is sealed by the pressing body through the soft material. As a result, dust will not enter the interior of the case body, thereby protecting the microswitch.

Furthermore, it is preferable that a bumper be mounted around the suction port base and the suction port hood, and the end portion of the bumper be clamped between the suction port base and the suction port hood.

When the bumper is mounted around the suction port body in this manner, external impact is reduced, thereby preventing a failure of the cleaner. As the end portion of the bumper is clamped between the suction port hood and the suction port base, the air-tightness of the suction port body is improved, thereby preventing air leakage from a gap between the suction port hood and the suction port base.

Preferred embodiments of the upright vacuum cleaner according to the present invention will be described with reference to the accompanying drawings.

Figure 2:
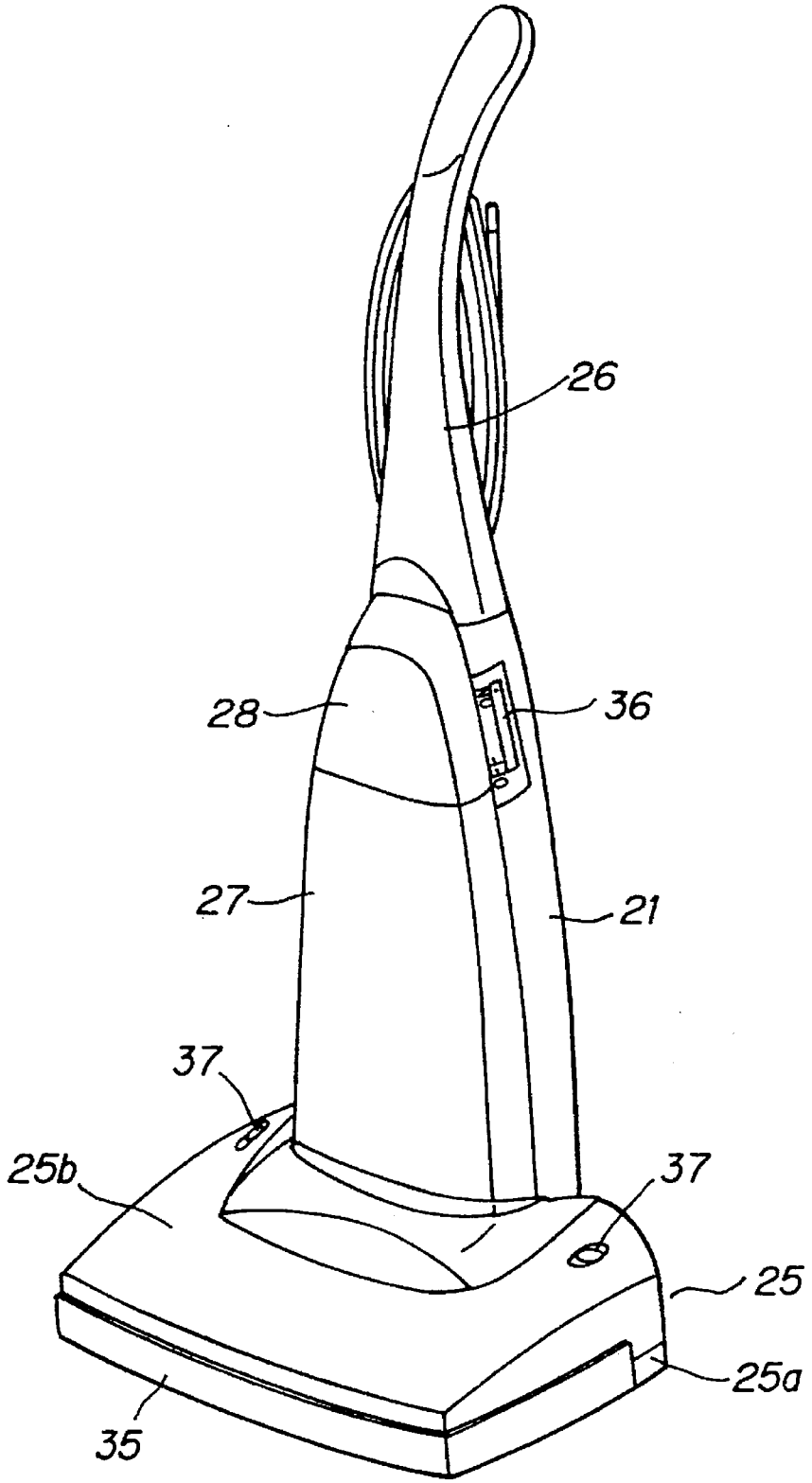
FIG. 2 is a perspective view of the outer appearance of an upright vacuum cleaner according to the present invention.
Figure 3:
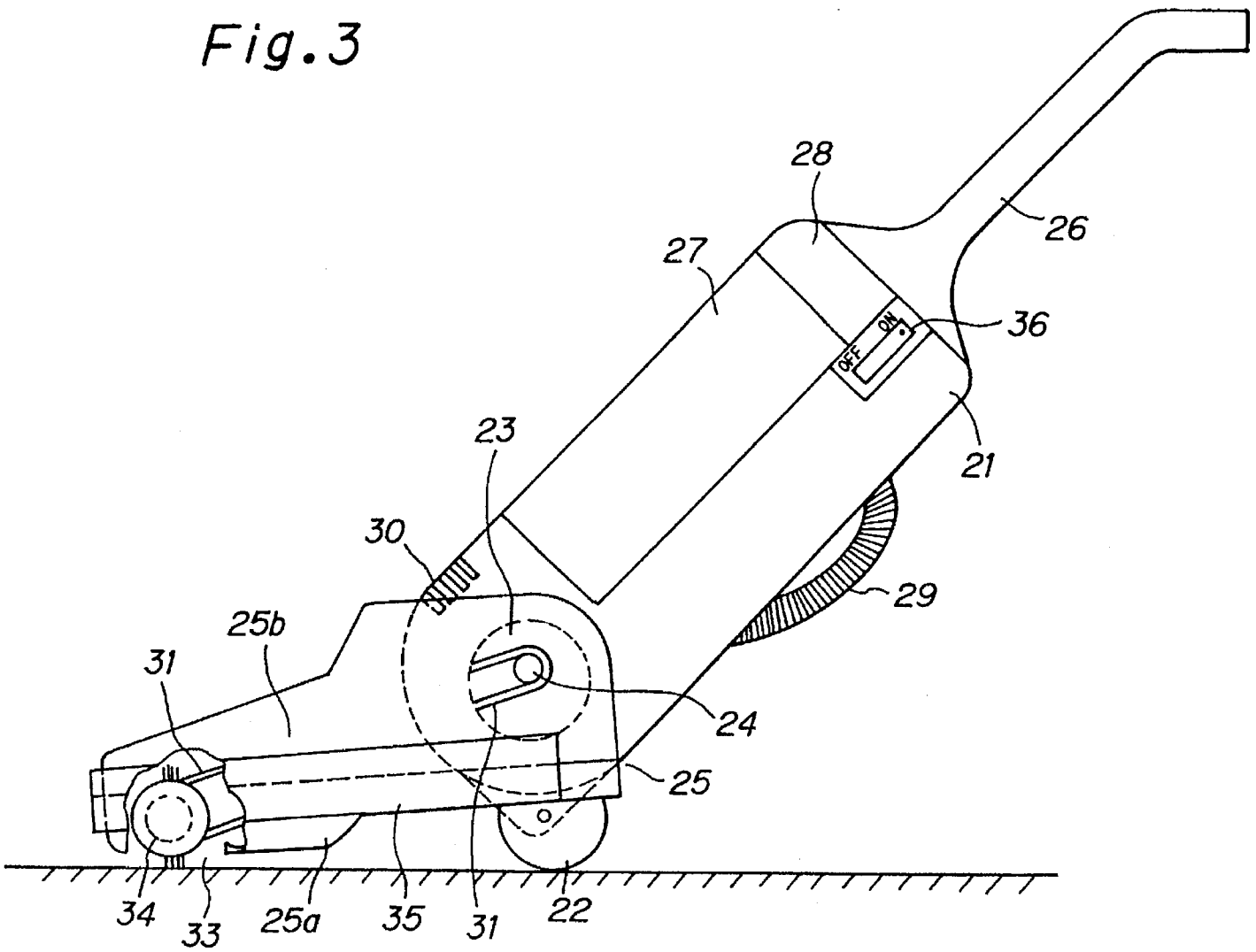
FIG. 3 is a side view of the upright vacuum cleaner shown in FIG. 2.

FIG. 2 is a perspective view of the outer appearance of the upright vacuum cleaner according to an embodiment of the present invention. FIG. 3 is a side view of the upright vacuum cleaner shown in FIG. 2.

Referring to FIGS. 2 and 3, a suction port body 25 is divided into a suction port base 25*a* and a suction port hood 25*b*. The suction port base 25*a* has a substantially rectangular suction port 33 through which a rotary brush 34 for cleaning the floor surface is exposed, and axially and rotatably supports the rotary brush 34. A handle body 21 has wheels 22 at its bottom portion, and, in its lower portion, incorporates a suction fan motor 23 assembly having a fan motor and impeller (not shown). The lower end portion of the handle body 21 is axially supported by the suction port base 25*a* to be tiltable. More specifically, the handle body 21 is mounted to the suction port base 25*a* to be tiltable about a shaft 24 of the fan motor 23 which serves as the tilting fulcrum. A handle 26 is fixed on the handle body 21. A dust collecting case 27 for collecting dust drawn by suction is detachably mounted to the front surface of the handle body 21.

Figure 4:
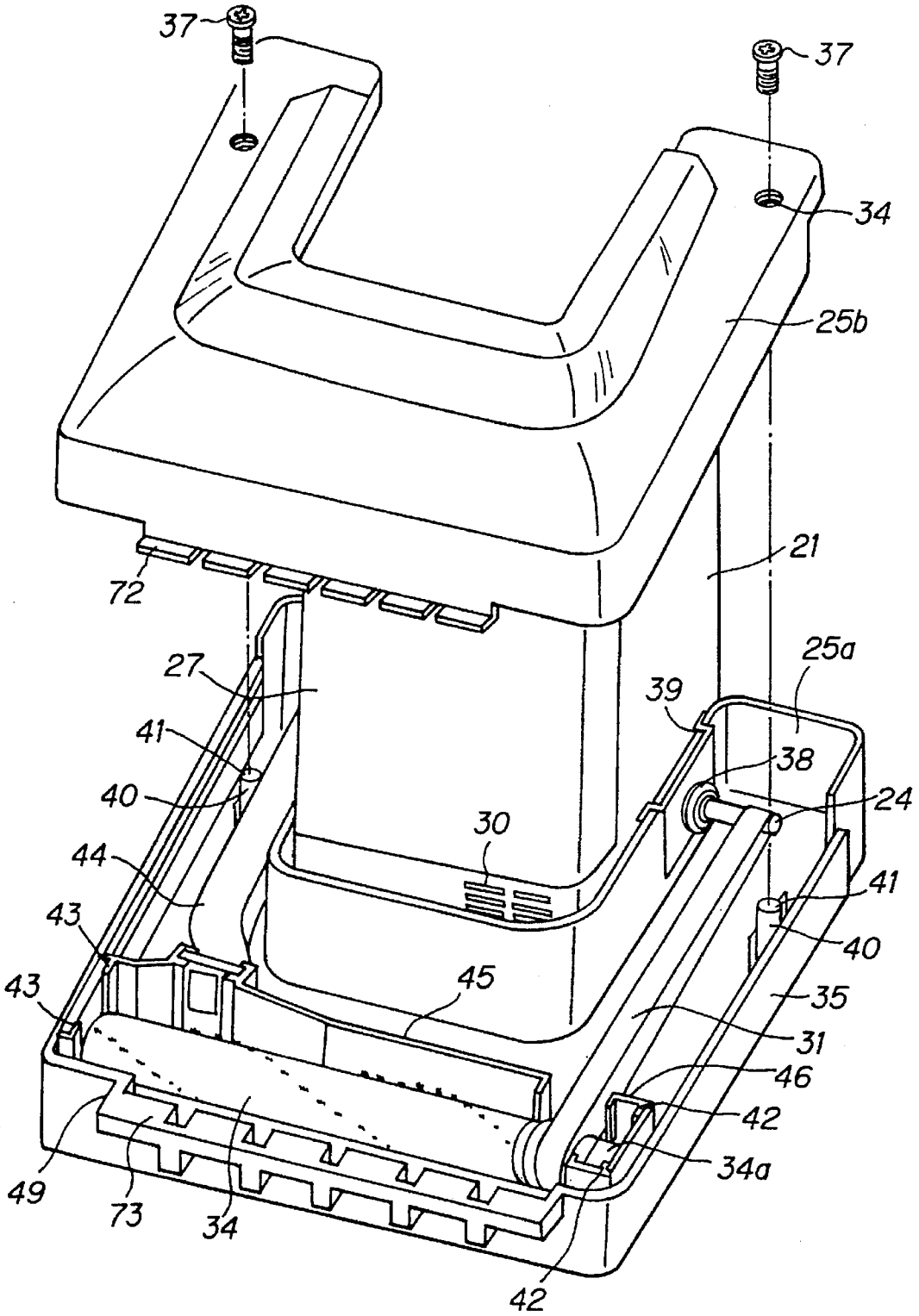
FIG. 4 is an exploded perspective view of the suction port body of the present invention.

The fan motor 23 is disposed to be concentric with the axial mounting point of the handle body 21 and the suction port body 25, and its shaft 24 projects into the suction port base 25*a*, as shown in FIG. 4. A belt 31 extends between the shaft 24 and the rotary brush 34 to transmit the rotating force of the fan motor 23 to the rotary brush 34.

A panel 28 incorporates a power control board for adjusting an input to the fan motor 23. Dust removed by the rotary brush 34 and drawn by suction through the suction port 33 formed in the suction port base 25*a* is collected in the dust collecting bag mounted in the dust collecting case 27 through a hose 29, and air from which dust is removed is exhausted through an exhaust port 30.

A bumper 35 is mounted on the front and two side surfaces of the suction port base 25*a* to overlap the suction port hood 25*b*. A power switch 36 is mounted to the handle body 21. The suction port hood 25*b* is mounted to the suction port base 25*a* with screws 37, as shown in FIG. 4 to be described later, so as to constitute the suction port body 25.

Figure 5:
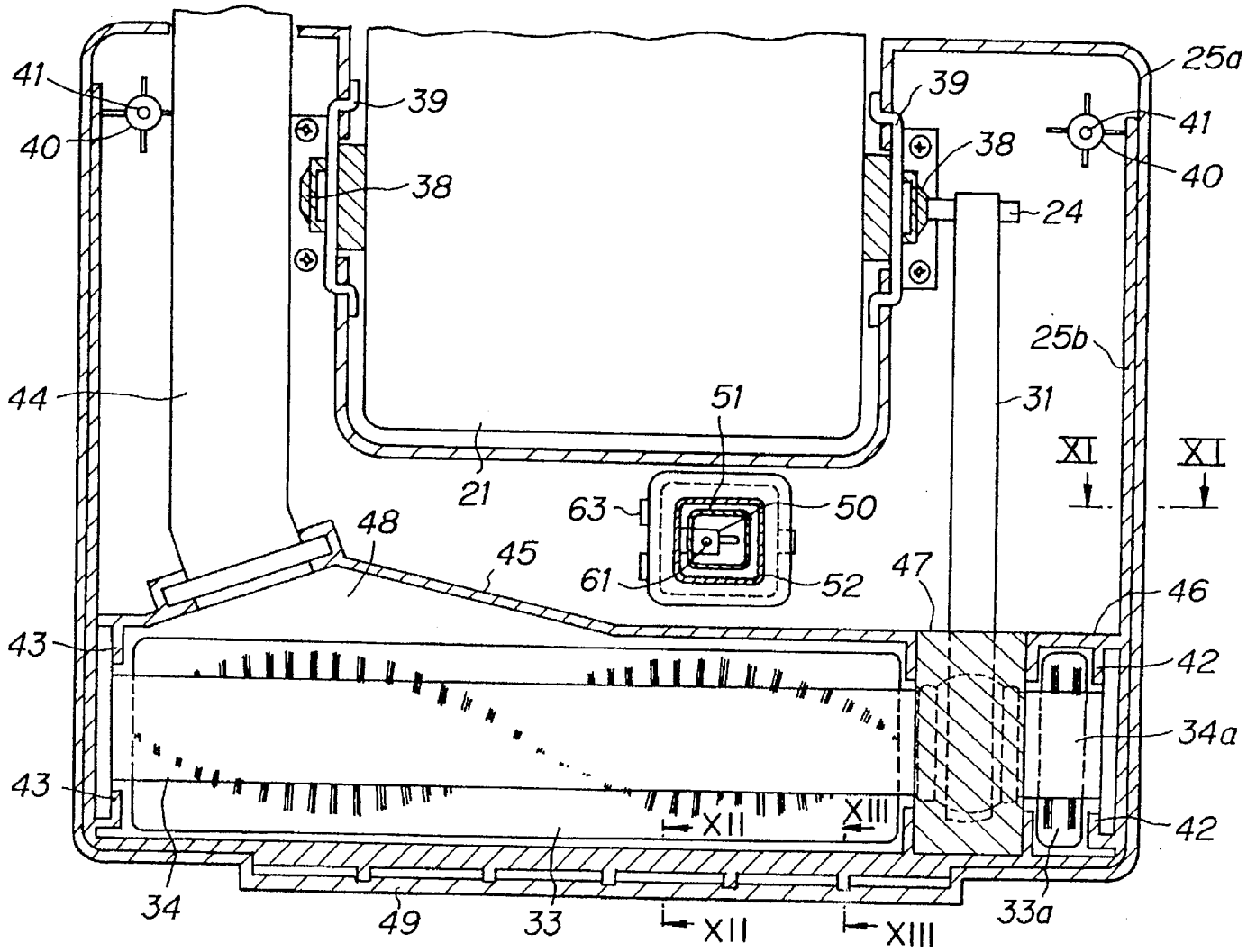
FIG. 5 is a sectional view of the suction port body of the present invention which is seen from above.

FIG. 4 is an exploded perspective view of the suction port body of the present invention. FIG. 5 is a sectional view of the suction port body of the present invention which is seen from above.

As shown in FIGS. 4 and 5, the shaft 24 of the fan motor 23 and projecting portions 38 of the handle body 21 are arranged within the suction port base 25*a*, and retaining metal members 39 slightly larger in diameter than the projecting portions 38 are fixed to the suction port base 25*a*, so that the handle body 21 can be tilted with respect to the suction port body 25 about the rotating shaft of the fan motor 23 as the tilting fulcrum.

Bosses 40 extend upright on the two sides of the suction port base 25*a*. Each boss 40 has a screw hole 41. Opening portions 54 are formed in the suction port hood 25*b* at positions corresponding to the positions of the screw holes 41 of the bosses 40. Hence, the suction port hood 25*b* can be mounted to the suction port base 25*a* by using the screws 37.

Ribs 42 and 43 are provided to the suction port base 25*a* to rotatably axially support the rotary brush 34 exposed through the suction port 33 and an auxiliary brush 34*a* exposed through an auxiliary suction port 33*a*.

Dust collected by the suction force of the fan motor 23 is sent to the hose 29 through a duct 44. Partition walls 45 and 46 are formed to surround the rotary brush 34 and the auxiliary brush 34*a*. Thus, when the suction port hood 25*b* is fitted on the suction port base 25*a*, the partition walls 45 and 46 form one partition chamber 48 together with a pulley cover 47 to secure good suction performance.

A stepped portion 49 is provided on the front surface of the suction port base 25*a* to seal the suction port hood 25*b* and to engage with the bumper (not shown). As shown in FIG. 5, a microswitch 50 is fixed in the suction port base 25*a*, and ribs 51 and 52 to engage with the suction port hood 25*b* are formed around the microswitch 50. The microswitch 50 is connected in series with the terminals of the fan motor 23 through the opening portions (not shown) of the projecting portions 38 of the handle body 21.

Figure 6:
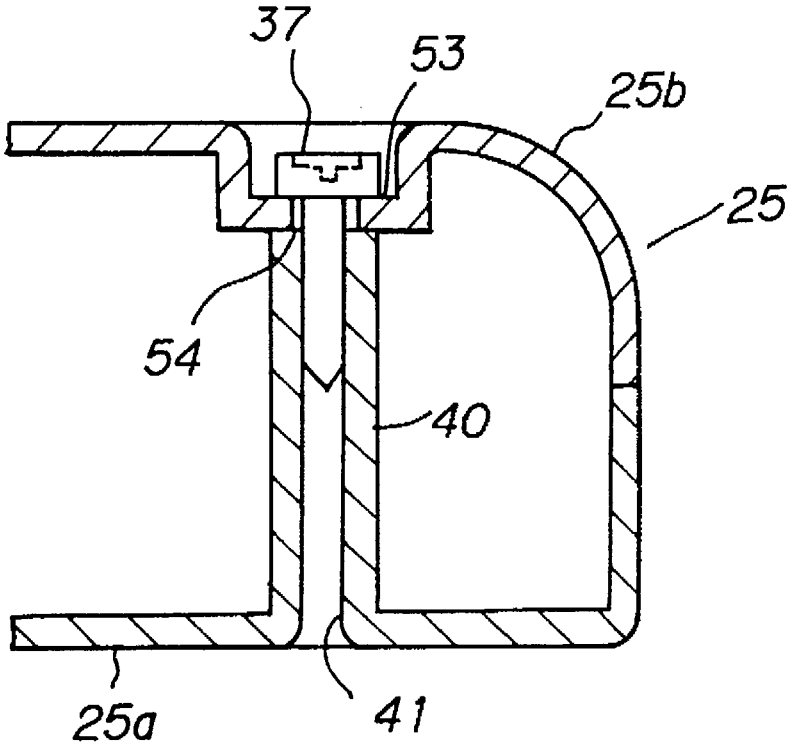
FIG. 6 is a partial sectional view showing an embodiment of a mounted state of a suction port hood and a suction port base.

FIG. 6 is a partial sectional view showing a mounted state of the suction port hood and the suction port base.

Referring to FIG. 6, the suction port base 25*a* and the suction port hood 25*b* are mounted to each other with the screws 37 through the screw holes 41 of the bosses 40 extending upright on the suction port base 25*a* and through opening portions 54 formed in stepped portions 53 of the suction port hood 25*b* to be larger than the screw holes 41, thereby constituting the suction port body 25.

Figure 7:
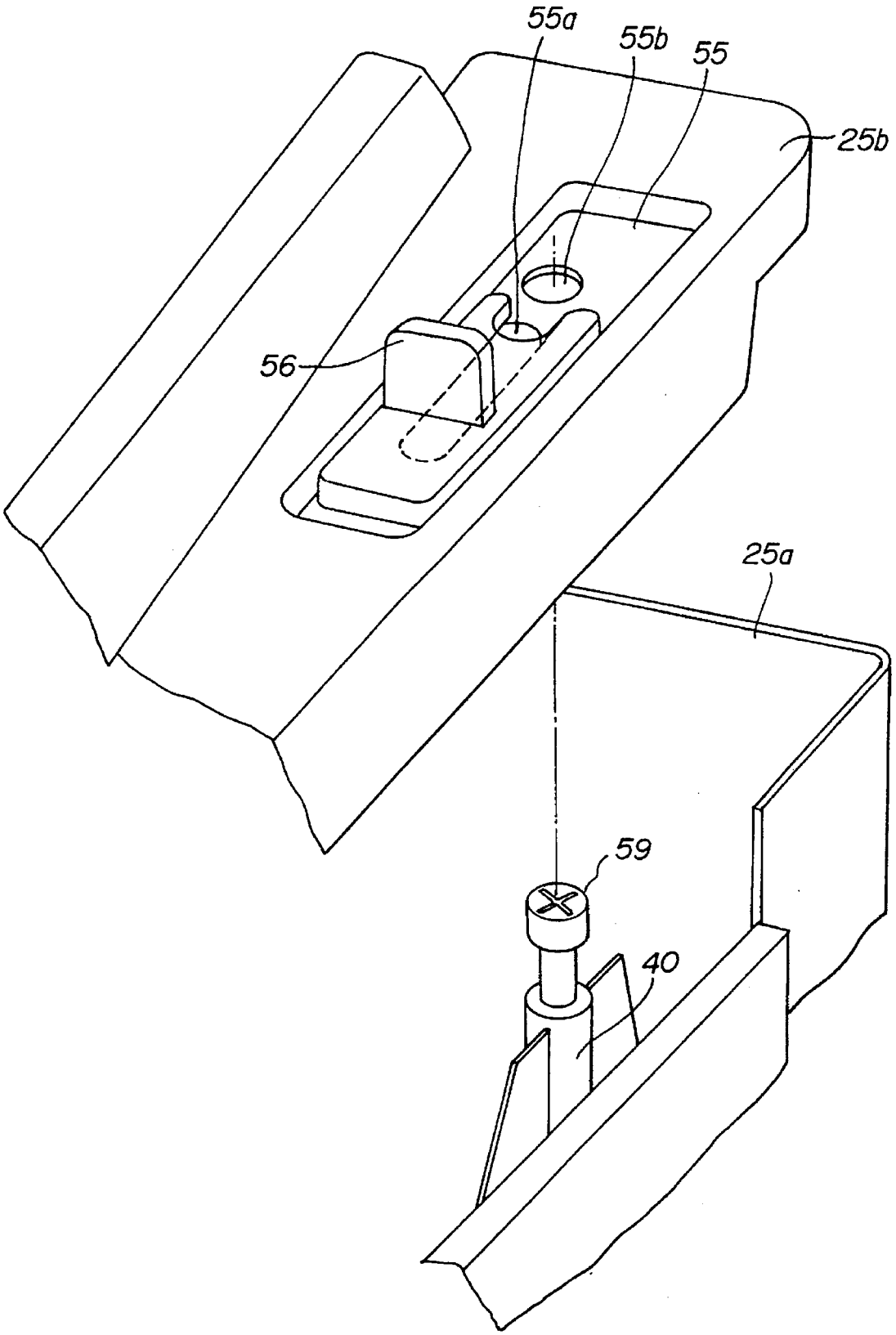
FIG. 7 is an exploded perspective view showing another embodiment of a mounted state of the suction port base and the suction port hood.
Figure 8:
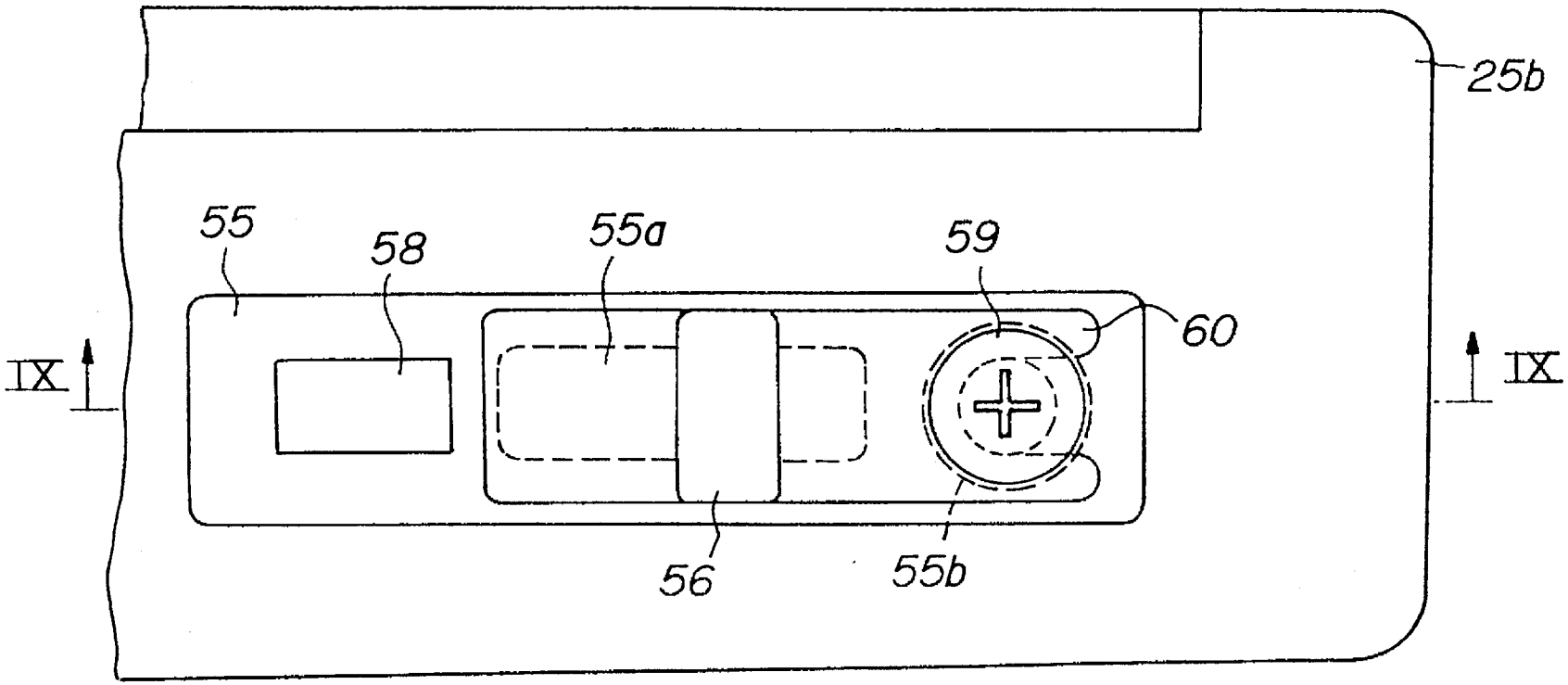
FIG. 8 is a partial plan view of FIG. 7.
Figure 9:
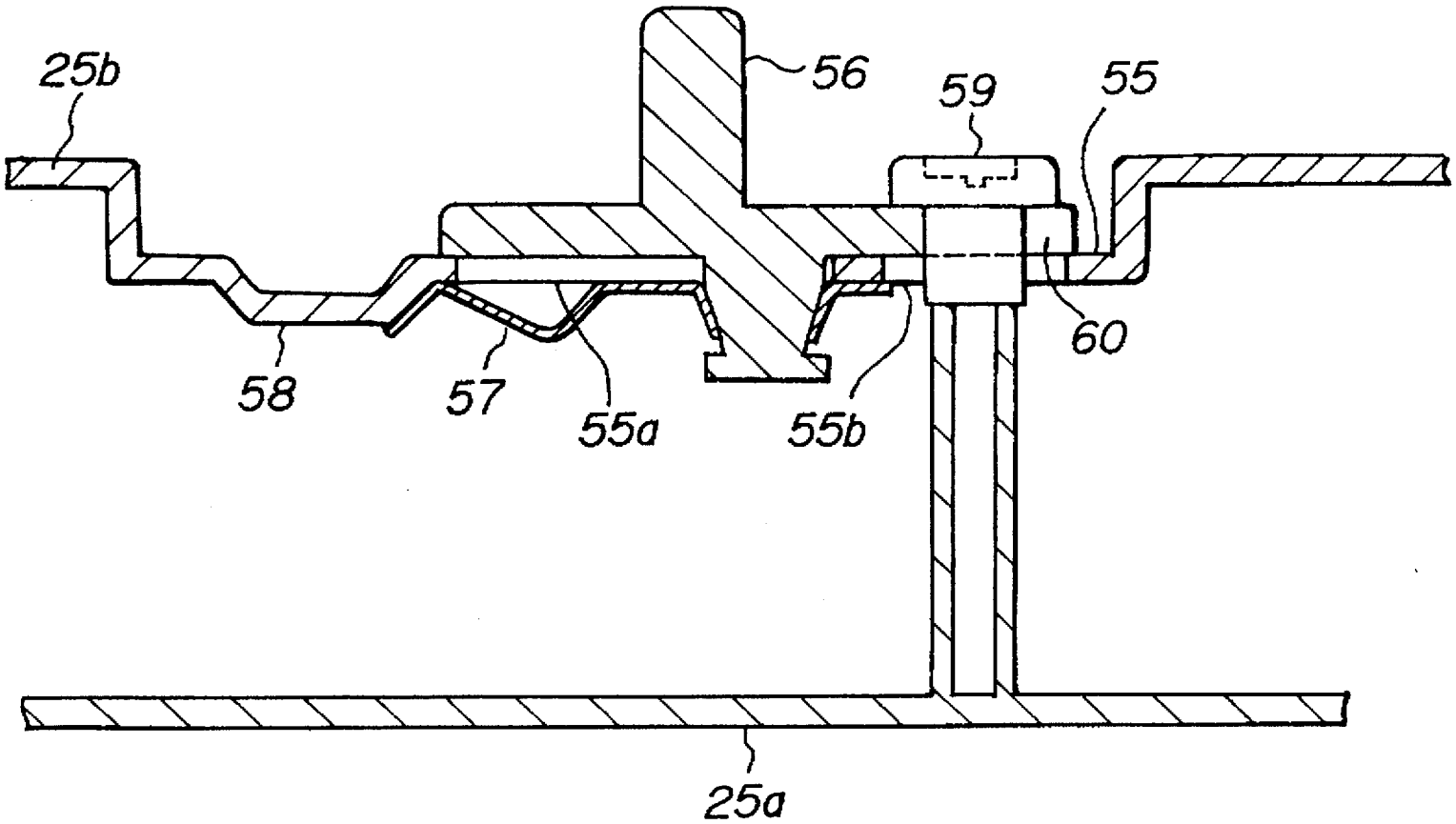
FIG. 9 is a partial sectional view taken along the line IX—IX of FIG. 8.

FIG. 7 is an exploded perspective view showing another mounted state of the suction port hood and the suction port base, and FIG. 8 is a partial plan view of FIG. 7. FIG. 9 is a partial sectional view taken along the line XI—XI of FIG. 8.

As shown in FIGS. 7 to 9, a suction port hood 25*b* is fixed to a suction port base 25*a* with stepped locking bodies 59 fixed to bosses 40 extending upright on the suction port base 25*a* and knobs 56 slidable on the suction port hood 25*b* and having U-shaped notched portions 60.

More specifically, stepped portions 55 are formed in the suction port hood 25*b*, and an opening portion 55*a* is formed in each stepped portion 55 so that the knobs 56 can slide onto the corresponding stepped portions 55. Each knob 56 is mounted by fitting a spring 57 from the lower surface of the corresponding stepped portion 55. A stepped locking body 59 is fixed to each boss 40 extending upright on the suction port base 25*a*. Opening portions 55*b* slightly larger in diameter than the head portions of the locking bodies 59 are formed in the stepped portions 55 of the suction port hood 25*b* at positions corresponding to the positions of the locking bodies 59.

Therefore, when this suction port hood 25*b* is mounted to the suction port base 25*a*, the locking bodies 59 project through the opening portions 55*b*. When the knobs 56 are slid toward the projecting locking bodies 59, the notched portions 60 of the knobs 56 are fitted between the head portions of the locking bodies 59 and the stepped portions 55, thereby fixing the suction port hood 25*b* and the suction port base 25*a* to each other.

If stepped portions 58 are further formed in the stepped portions 55, the springs 57 extend over the stepped portions 58 to provide a click touch upon sliding the knobs 56 toward the stepped portions 58. Also, when the notched portions 60 of the knobs 56 are fitted between the head portions of the locking bodies 59 and the stepped portions 55 to fix the suction port hood 25*b* and the suction port base 25*a* to each other, the stepped portions 58 serve as the stoppers for the springs 57.

Figure 10:
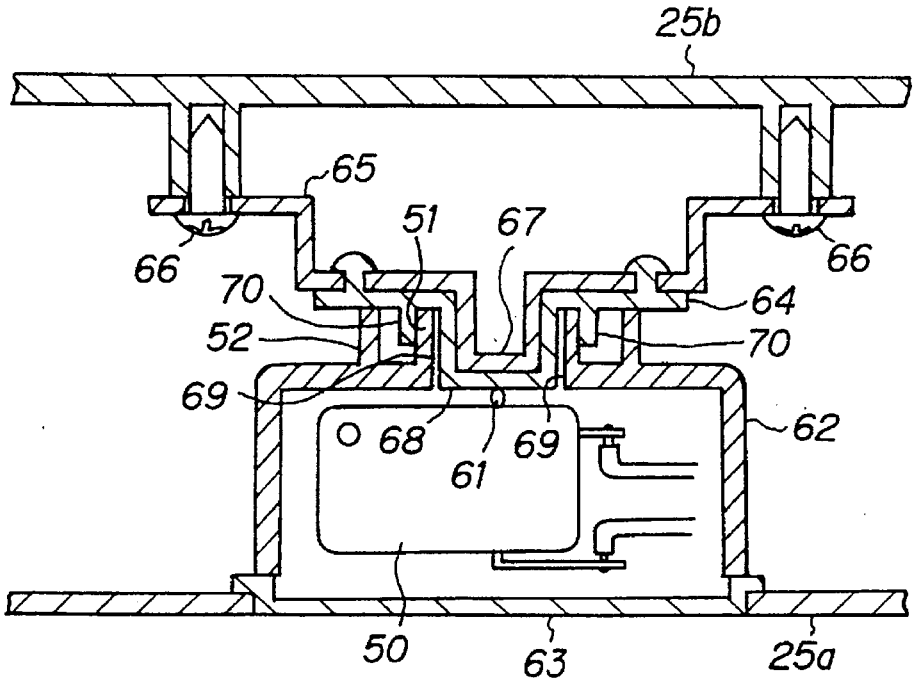
FIG. 10 is a partial sectional view showing a housed state of the microswitch of the present invention.

FIG. 10 is a partial sectional view showing the housing of the microswitch of the present invention.

As shown in FIG. 10, a bottom plate 63 is disposed on the suction port base 25*a*, and the microswitch 50 having an operation button 61 incorporating an elastic body is placed on the bottom plate 63. When the operation button 61 is pressed, its contact is closed; when released, its contact is opened. A case body 62 is provided around the microswitch 50 to cover it. An opening portion 68 is formed in the case body 62 so that the operation button 61 of the microswitch 50 can be pressed from the outside, and ribs 51 and 52 extend upright around the opening portion 68.

A pressing body consisting of an operational plate 65 mounted to the suction port hood 25*b* with screws 66 and a projecting portion 67 having a convex shape is provided to the suction port hood 25*b*. Thus, when the suction port hood 25*b* is mounted to the suction port base 25*a*, the projecting portion 67 enters the case body 62 through the opening portion 68 and presses the operation button 61, thereby closing the circuit. Inversely, when the suction port hood 25*b* is removed from the suction port base 25*a*, the projecting portion 67 separates from the operation button 61 to open the circuit, thereby stopping rotation of the fan motor 23.

A seal member 64, e.g., rubber, having elasticity may be provided to the surface of the projecting portion 67. Then, when the suction port hood 25*b* is mounted to the suction port base 25*a*, the seal member 64 is brought into tight contact with a wall surface portion 69 above the opening portion 68, and a projecting portion 70 of the seal member 64 is also brought into tight contact with the rib 51. Thus, dust will not enter the microswitch 50.

Figure 11:
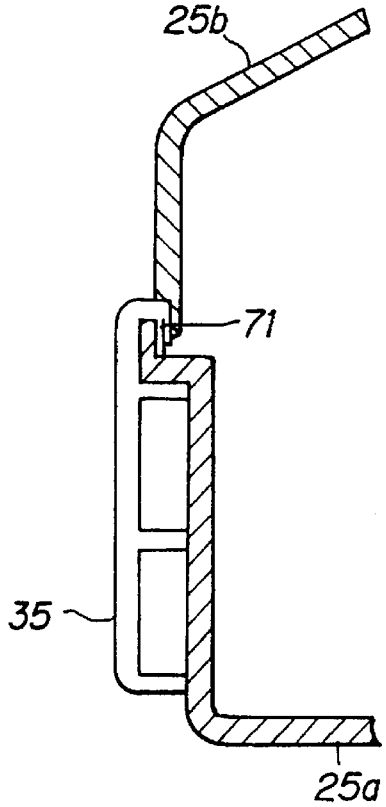
FIG. 11 is a partial sectional view showing a mounted state of a bumper taken along the line XI—XI of FIG. 5.
Figure 12:
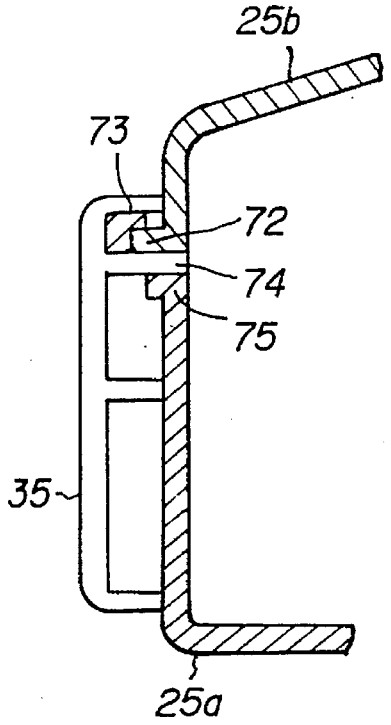
FIG. 12 is a partial sectional view showing a mounted state of the bumper taken along the line XII—XII of FIG. 5.
Figure 13:
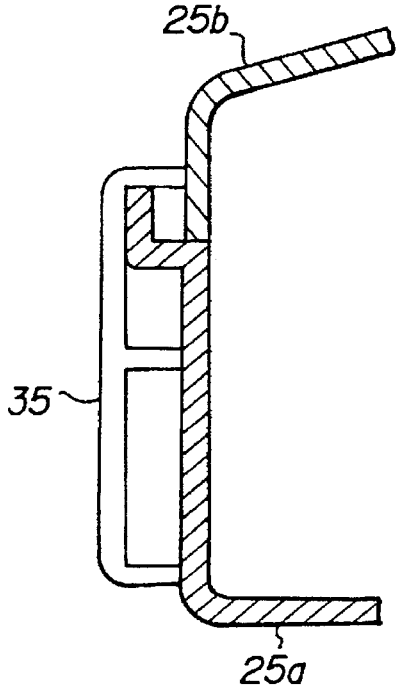
FIG. 13 is a partial sectional view showing the mounted state of the bumper taken along the line XIII—XIII of FIG. 5.

FIGS. 11, 12, and 13 are sectional views showing the mounted state of the bumper taken along the lines XI—XI, XII—XII, XIII—XIII, respectively, of FIG. 5.

As shown in FIG. 11, a lip portion 71 of the bumper 35 is locked by the end portion of the suction port base 25*a*. When the suction port hood 25*b* is mounted to the suction port base 25*a*, the lip portion 71 is clamped between the suction port hood 25*b* and the suction port base 25*a*. Thus, the suction port body 25 is sealed by the bumper 35, thereby preventing air leakage from the two side surfaces of the suction port base 25*a*. With this structure, the bumper 35 can decrease an impact generated upon collision of the suction port base 25*a* with a wall or the like, and can also serve as a seal between the suction port base 25*a* and the suction port hood 25*b*.

As shown in FIGS.12 and 13, when mounting the suction port hood 25*b* to the suction port base 25*a*, first, a pawl portion 72 of the suction port hood 25*b* is inserted in and locked by a locking portion 73 of the suction port base 25*a*, and is fixed with screws (see FIG. 4) from the suction port hood 25*b* side. The shape of this bumper differs from that described with reference to FIG. 11 due to the presence of the pawl portion 72 at the front surface portion. However, if the bumper is formed by injection molding, its shape can be freely set. A lip portion 74 of the bumper 35 is clamped between the pawl portion 72 of the suction port hood 25*b* and an accepting portion 75 of the suction port base 25*a*. Thus, the suction port hood 25*b* and the suction port base 25*a* can be sealed from each other at the front surface portion.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An upright vacuum cleaner, comprising:

a suction port body incorporating a rotary brush for cleaning a floor surface;

a suction fan motor assembly for generating a suction force for drawing dust by suction, and for supplying a driving force to said rotary brush;

a dust collecting portion for collecting the dust drawn by said suction fan motor assembly; and a handle body incorporating said suction fan motor assembly, said assembly including a fan motor, and said dust collecting portion and mounted to said suction port body to be tiltable about a rotating shaft of said fan motor which serves as a tilting fulcrum, wherein said suction port body comprises a suction port base having a substantially rectangular suction port at a front lower surface thereof through which said rotary brush is exposed, for rotatably axially supporting said rotary brush, and at least one uprightly extending boss portion fixedly attached thereto, and a suction port hood detachably mounted to said suction port base and having an opening portion disposed at a position corresponding to the position of each of said at least one boss portion when said suction port hood is mounted to said suction port base.

2. The upright vacuum cleaner according to claim 1, wherein at least one of said at least one boss portion has a screw hole therein for receiving a screw when said suction port hood is mounted to said suction port base.

3. The upright vacuum cleaner according to claim 2, further comprising a microswitch connected in series with said fan motor, said microswitch having an upper surface at which an operation button is disposed, wherein said suction port base includes a case body having an opening portion defined at an upper portion thereof, said microswitch being disposed within said case body, and said suction port hood has a convex activation body, said activation body activating said operation button when said suction port hood is mounted to said suction port base.

4. The upright vacuum cleaner according to claim 3 wherein a surface of said pressing body is covered with a sealing member such that when said suction port hood is mounted to said suction port base said sealing member closes the opening portion of said case body.

5. The upright vacuum cleaner according to claim 2, further comprising a bumper mounted around said suction port base and said suction port hood, an end portion of said bumper being clamped between said suction port base and said suction port hood.

6. The upright vacuum cleaner according to claim 1, wherein at least one of said at least one boss portion has a stepped locking body structure, each said locking body structure projecting through one of said opening portions when said suction port hood is mounted to said suction port base, and said suction port hood has a locking device on a surface thereof corresponding to each of said at least one opening portion, said locking device having a notched portion slidable between an engaged position with said locking body structure and a disengaged position therewith, each said notched portion being engageable with said locking body structure projecting through each said opening portion.

7. The upright vacuum cleaner according to claim 6 further comprising a microswitch connected in series with said fan motor, said microswitch having an upper surface at which an operation button is disposed, wherein said suction port base includes a case body having an opening portion defined at an upper portion thereof, said microswitch being disposed within said case body, and said suction port hood has a convex activation body, said activation body activating said operation button when said suction port hood is mounted to said suction port base.

8. The upright vacuum cleaner according to claim 7 wherein a surface of said pressing body is covered with a sealing member such that when said suction port hood is mounted to said suction port base said sealing member closes the opening portion of said case body.

9. The upright vacuum cleaner according to claim 6 further comprising a bumper mounted around said suction port base and said suction port hood, an end portion of said bumper being clamped between said suction port base and said suction port hood.

10. The upright vacuum cleaner according to claim 1, further comprising a microswitch connected in series with said fan motor, said microswitch having an upper surface at which an operation button is disposed, wherein said suction port base includes a case body having an opening portion defined at an upper portion thereof, said microswitch being disposed within said case body, and said suction port hood has a convex activation body, said activation body activating said operation button when said suction port hood is mounted to said suction port base.

11. The upright vacuum cleaner according to claim 10, wherein a surface of said pressing body is covered with a sealing member such that when said suction port hood is mounted to said suction port base said sealing member closes the opening portion of said case body.

12. The upright vacuum cleaner according to claim 1, further comprising a bumper mounted around said suction port base and said suction port hood, an end portion of said bumper being clamped between said suction port base and said suction port hood.

* * * * *